US005207844A

United States Patent [19]

Watanabe et al.

[11] Patent Number: 5,207,844

[45] Date of Patent: May 4, 1993

[54] METHOD FOR MANUFACTURING AN FE-NI COLD-ROLLED SHEET EXCELLENT IN CLEANLINESS AND ETCHING PIERCEABILITY

[75] Inventors: Atsushi Watanabe; Teruyuki Hasegawa; Tadashi Inoue; Tomoyoshi Okita; Yoshiteru Kikuchi; Hidetoshi Matsuno, all of Tokyo, Japan

[73] Assignee: NKK Corporation, Tokyo, Japan

[21] Appl. No.: 887,385

[22] Filed: May 18, 1992

Related U.S. Application Data

[63] Continuation of Ser. No. 667,968, Mar. 12, 1991, abandoned.

[30] Foreign Application Priority Data

Mar. 22, 1990 [JP] Japan ..... 2-72651

[51] Int. Cl.[5] ..... C22C 38/08

[52] U.S. Cl. ..... 148/546; 148/310; 148/336

[58] Field of Search ..... 148/546, 310, 336; 75/568, 567; 420/129, 94, 85

[56] References Cited

U.S. PATENT DOCUMENTS 4,729,787 3/1988 Ototani et al. ..... 75/567
4,944,798 7/1990 Ototani et al. ..... 420/85
5,002,619 3/1991 Tsuda et al. ..... 148/12 R

FOREIGN PATENT DOCUMENTS 2520384 7/1983 France .
161936 7/1987 Japan .

OTHER PUBLICATIONS

Patent Abstracts of Japan, vol. 12, No. 5 (C-467) (2852) Jan. 8, 1988 of JP-A-62-161 936 (Kawasaki Steel Corp.) Jul. 17, 1987.

Patent Abstracts of Japan, vol. 10, No. 131 (C-346) (2188) May 15, 1986 of JP-A-60-255 953 (Sumitomo Tokushiyu Kinzoku K. K.) Dec. 17, 1985.

Patent Abstracts of Japan, vol. 10, No. 182 (C-356) (2238) Jun. 25, 1986 of JP-A-62-030 646 (Daido Steel Co. Ltd.) Feb. 12, 1986.

Patent Abstracts of Japan, vol. 11, No. 3 (C-395) (2450) Jan. 7, 1987 of JP-A-61-179 849 (Daido Steel Co. Ltd.) Aug. 12, 1986.

Patent Abstracts of Japan, vol. 10, No. 203 (C-360) (2259) Jul. 16, 1986 of JP-A-61-044 156 (Nippon Mining Co. Ltd.) Mar. 3, 1986.

*Primary Examiner*—H. Dean
*Assistant Examiner*—Sikyin Ip
*Attorney, Agent, or Firm*—Frishauf, Holtz, Goodman & Woodward

[57] ABSTRACT

A method for manufacturing an Fe-Ni alloy cold-rolled sheet excellent in cleanliness and etching pierceability, comprising: preparing an Fe-Ni molten alloy, containing 30 to 45 wt. % nickel, and subjected to dephosphorization and decarburization; adding aluminum and flux to the Fe-Ni molten alloy in a ladle made of an MgO-CaO refractory containing 20 to 45 wt. %; strongly stirring the Fe-Ni molten alloy which contains the added aluminum and flux in the ladle to produce a $CaO-Al_2O_3-MgO$ slag so as to react the Fe-Ni molten alloy with the $CaO-Al_2O_3-MgO$ slag to deoxidize the Fe-Ni molten alloy while controlling a value of activity of $SiO_2$ from 0.001 to 0.005 and a value of activity of $Al_2O_3$ from 0.1 to 0.3 in the $CaO-Al_2O_3-MgO$ slag, and the $CaO-Al_2O_3-MgO$ slag having the following chemical composition: CaO and $Al_2O_3$: at least 57 wt. %, wherein the ratio of $CaO/(CaO+Al_2O_3)$ being at least 0.45, MgO: up to 25 wt. %, $SiO_2$: up to 15 wt. %, and oxides of metals having an oxygen affinity lower than that of silicon: up to 3 wt. % in total; casting the deoxidized Fe-Ni molten alloy into an ingot; and blooming, hot-rolling and cold-rolling the ingot to manufacture an Fe-Ni alloy cold-rolled sheet containing non-metallic inclusions comprising a composition in a region of a melting point of at least 1,600° C., which region is defined by a liquidus curve of 1,600° C. in a $CaO-Al_2O_3-MgO$ ternary phase diagram and having a particle size up to 6 μm in a total amount of up to 0.002 wt. % as converted into oxygen.

7 Claims, 9 Drawing Sheets

METHOD FOR MANUFACTURING AN FE-NI COLD-ROLLED SHEET EXCELLENT IN CLEANLINESS AND ETCHING PIERCEABILITY

This application is a continuation of application Ser. No. 07/667,968, filed Mar. 12, 1991 now abandoned.

FIELD OF THE INVENTION

The present invention relates to an Fe-Ni alloy cold-rolled sheet excellent in cleanliness and etching pierceability, which is applicable as a material for a shadow mask of a high-definition TV, free from a defect during the etching-piercing, and has a low thermal expansion coefficient, and a method for manufacturing same.

DESCRIPTION OF RELATED ART

An Fe-Ni alloy sheet is conventionally used mainly as a material for an electronic component. The Fe-Ni alloy sheet containing nickel in an amount of 42 wt. %, for example, which is excellent in electric conductivity, thermal resistance, bending workability, plating adhesivity and solderability, is used as a material for an IC lead frame. The Fe-Ni alloy sheet containing nickel in an amount of 36 wt. %, which has a very low thermal expansion coefficient, is used as a material for a shadow mask of a color TV or container for storing a low-temperature liquid.

An Fe-Ni alloy cold-rolled sheet as a material for a shadow mask of a high-definition TV, is required to be free from a defect during the etching-piercing and have a low thermal expansion coefficient.

As an Fe-Ni alloy cold-rolled sheet as a material for a shadow mask of a TV, the following one is proposed:

An Fe-Ni alloy cold-rolled sheet excellent in surface quality during the cold-rolling, disclosed in Japanese Patent Provisional Publication No. 62-161,936 dated Jul. 17, 1987, which consists essentially of:

| | |
|---|---|
| nickel | from 30 to 45 wt. %, |
| manganese | from 0.3 to 1.0 wt. %, |
| silicon | from 0.1 to 0.3 wt. %, |
| aluminum | from 0.0004 to 0.0020 wt. %, |

the balance being iron and incidental impurities, where non-metallic inclusions as said incidental impurities comprising a composition in a region in the $Al_2O_3$-MnO-$SiO_2$ ternary phase diagram as shown in FIG. 1, which region is surrounded by the line connecting sequentially the following Points 1 to 5:

| | |
|---|---|
| Point 1 | |
| $Al_2O_3$ | 4 wt. %, |
| MnO | 58 wt. %, |
| $SiO_2$ | 38 wt. %, |
| Point 2 | |
| $Al_2O_3$ | 5 wt. %, |
| MnO | 49 wt. %, |
| $SiO_2$ | 46 wt. %, |
| Point 3 | |
| $Al_2O_3$ | 23 wt. %, |
| MnO | 23 wt. %, |
| $SiO_2$ | 54 wt. %, |
| Point 4 | |
| $Al_2O_3$ | 27 wt. %, |
| MnO | 31 wt. %, |
| $SiO_2$ | 42 wt. %, and |
| Point 5 | |
| $Al_2O_3$ | 17 wt. %, |

-continued

| | |
|---|---|
| MnO | 54 wt. %, |
| $SiO_2$ | 29 wt. %, |

(hereinafter referred to as the "Prior Art").

The above-mentioned Prior Art involves the following problems: Since the non-metallic inclusions comprise a composition in a region in the $Al_2O_3$-MnO-$SiO_2$ ternary phase diagram as shown in FIG. 1, which region is surrounded by the line connecting sequentially Points 1, 2, 3, 4 and 5, the non-metallic inclusions comprise a composition in a region, close to spessartite, which is surrounded by the liquidus curve of 1,200° C. which is the lowest temperature. As a result, the non-metallic inclusions have a low melting point and a high deformability, and are large in the total content. If the non-metallic inclusions have a large particle size or the non-metallic inclusions comprise a large amount of low-melting-point compounds, and when the alloy ingot is hot-rolled and cold-rolled to prepare a cold-rolled sheet, the non-metallic inclusions in the cold-rolled sheet are linearly deformed, and this may result in the production of a defect during the etching-piercing.

Under such circumstances, there is a demand for an Fe-Ni alloy cold-rolled sheet excellent in cleanliness and etching pierceability, which is applicable as a material for a shadow mask of a high-definition TV, free from a defect during the etching-piercing, and has a low thermal expansion coefficient, but such an Fe-Ni alloy cold-rolled sheet and a method for manufacturing same have not as yet been proposed.

SUMMARY OF THE INVENTION

An object of the present invention is therefore to provide an Fe-Ni alloy cold-rolled sheet excellent in cleanliness and etching pierceability, which is applicable as a material for a shadow mask of a high-definition TV, free from a defect during the etching-piercing, and has a low thermal expansion coefficient, and a method for manufacturing same.

In accordance with one of the features of the present invention, there is provided an Fe-Ni alloy cold-rolled sheet excellent in cleanliness and etching pierceability, which consists essentially of:

| | |
|---|---|
| nickel | from 30 to 45 wt. %, |
| manganese | from 0.1 to 1.0 wt. %, |
| aluminum | from 0.003 to 0.030 wt. %, |

the balance being iron and incidental impurities, where the respective contents of silicon, chromium, carbon, nitrogen, sulfur, phosphorus, oxygen and non-metallic inclusions as said incidental impurities being:

up to 0.4 wt. % for silicon,
up to 0.1 wt. % for chromium,
up to 0.005 wt. % for carbon,
up to 0.005 wt. % for nitrogen,
up to 0.005 wt. % for sulfur,
up to 0.010 wt. % for phosphorus,
up to 0.002 wt. % for oxygen, and
up to 0.002 wt. % as converted into oxygen for non-metallic inclusions;

said non-metallic inclusions comprising a composition having a particle size of up to 6 μm in a region of a melting point of at least 1,600° C., which region is defined by the liquidus curve of 1,600° C. in the CaO- $Al_2O_3$-MgO ternary phase diagram, and said composition containing at least one of CaO, $Al_2O_3$ and MgO.

In accordance with another feature of the present invention, there is provided a method for manufacturing an Fe-Ni alloy cold-rolled sheet excellent in cleanliness and etching pierceability, which comprises the steps of:

preparing an Fe-Ni molten alloy, containing nickel in an amount within a range of from 30 to 45 wt. %, and subjected to dephosphorization and decarburization;

adding aluminum to said Fe-Ni molten alloy thus prepared, in a ladle made of an MgO-CaO refractory containing CaO in an amount within a range of from 20 to 40 wt. %;

causing said Fe-Ni molten alloy added with aluminum to react, in said ladle, with a CaO-$Al_2O_3$-MgO slag comprising:

| | |
|---|---|
| CaO and $Al_2O_3$ where, the ratio of CaO/(CaO + $Al_2O_3$) being at least 0.45, | at least 57 wt. %, |
| MgO | up to 25 wt. %, |
| $SiO_2$ | up to 15 wt. %, |
| and oxides of metals having an oxygen affinity lower than that of silicon | up to 3 wt. % in total, |

to deoxidize said Fe-Ni molten alloy;

casting said deoxidized Fe-Ni molten alloy into an ingot; and blooming, hot-rolling and cold-rolling said ingot to manufacture an Fe-Ni alloy cold-rolled sheet containing non-metallic inclusions having a particle size of up to 6 μm in a total amount of up to 0.002 wt. % as converted into oxygen.

DETAILED DESCRIPTION OF THE PREFERRED EMBODIMENTS

Figure 1:
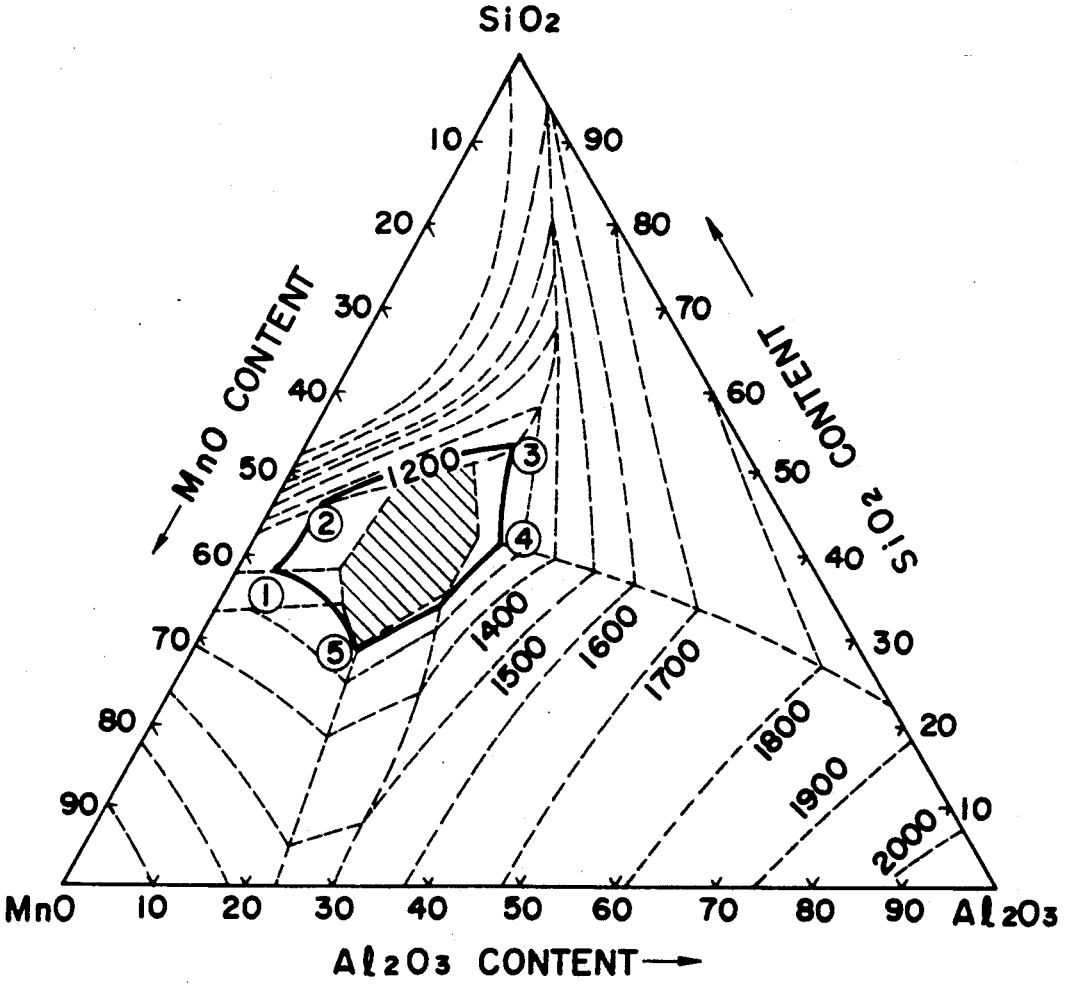
FIG. 1 is the $Al_2O_3$-MnO-$SiO_2$ ternary phase diagram illustrating the region of the composition of non-metallic inclusions present in a conventional Fe-Ni alloy cold-rolled sheet.

From the above-mentioned point of view, extensive studies were carried out to develop an Fe-Ni alloy cold-rolled sheet excellent in cleanliness and etching pierceability, which is applicable as a material for a shadow mask of a high-definition TV, free from a defect during the etching-piercing, and has a low thermal expansion coefficient, and a method for manufacturing same.

As a result, the following findings were obtained: By preparing an Fe-Ni molten alloy, containing nickel in an amount within a range of from 30 to 45 wt. %, and subjected to dephosphorization and decarburization; adding aluminum to the Fe-Ni alloy thus prepared, in a ladle made of a MgO-CaO refractory containing CaO in an amount within a range of from 20 to 40 wt. %; causing the Fe-Ni molten alloy added with aluminum to react, in the ladle, with a CaO-$Al_2O_3$-MgO slag comprising:

| | |
|---|---|
| CaO and $Al_2O_3$ where, the ratio of CaO/(CaO + $Al_2O_3$) being at least 0.45, | at least 57 wt. %, |
| MgO | up to 25 wt. %, |
| $SiO_2$ | up to 15 wt. %, |
| and oxides of metals having an oxygen affinity lower than that of silicon | up to 3 wt. % in total, |

to deoxidize the Fe-Ni molten alloy; the amount of residual oxygen in the molten alloy decreases, and oxides produced in the molten alloy are absorbed into the slag. As a result, the total amount of the non-metallic inclusions present in the Fe-Ni alloy cold-rolled sheet as converted into oxygen becomes 0.002 wt. % or under. In other words, not only the total amount of non-metallic inclusions precipitating during the solidification of the above-mentioned molten alloy becomes smaller according as the amount of residual oxygen in the molten alloy decreases, but also the growth of particle size of the non-metallic inclusions is inhibited because of the absence of low-melting-point suspensions forming the precipitation nuclei.

Figure 2:
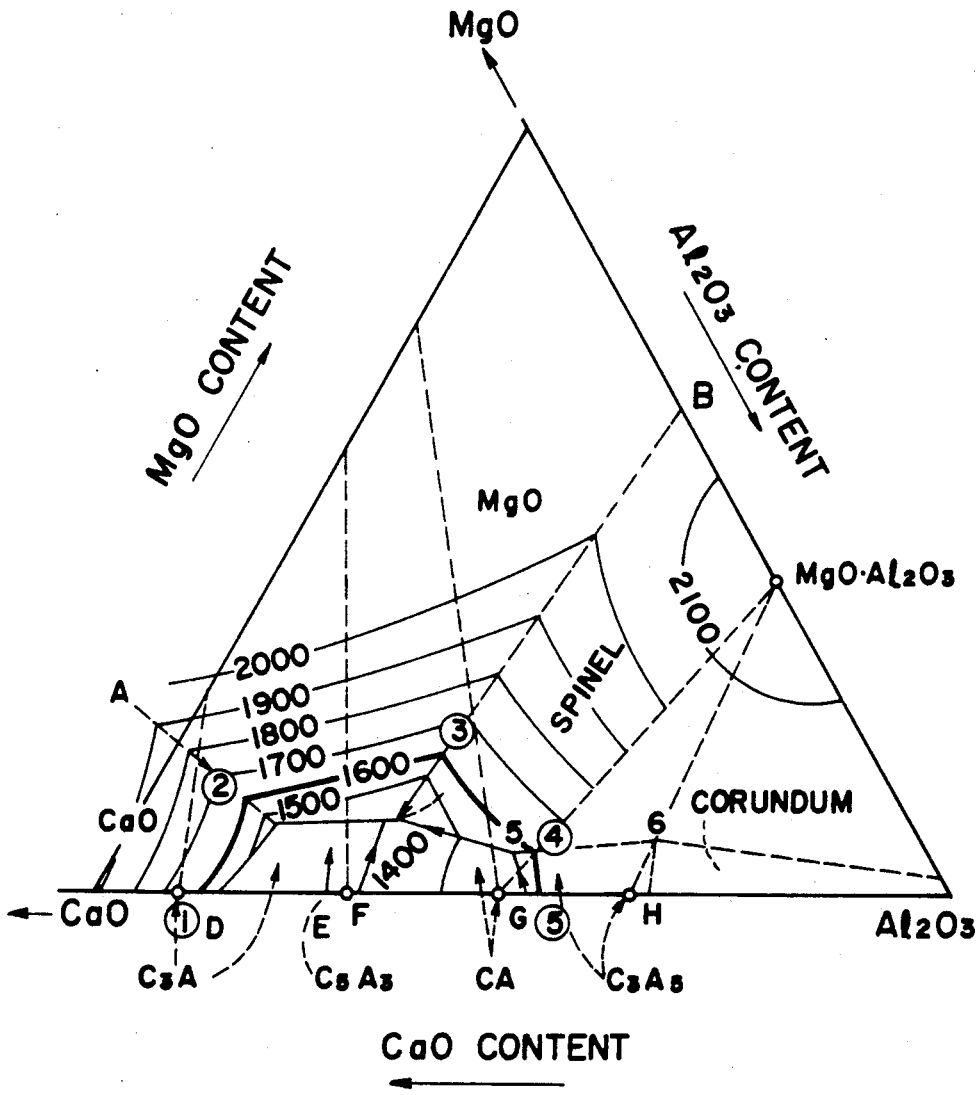
FIG. 2 is the CaO-$Al_2O_3$-MgO ternary phase diagram illustrating the region of the composition of non-metallic inclusions present in the Fe-Ni alloy cold-rolled sheet of the present invention.

The non-metallic inclusions present in the Fe-Ni alloy cold-rolled sheet comprise a composition in a region other than that surrounded, in the CaO-$Al_2O_3$-MgO ternary phase diagram shown in FIG. 2, by the line connecting sequentially the following Points 1 to 5:

| | |
|---|---|
| Point 1 | |
| CaO | 60.8 wt. %, |
| $Al_2O_3$ | 39.2 wt. %, |
| MgO | 0 wt. %, |
| Point 2 | |
| CaO | 55.3 wt. %, |
| $Al_2O_3$ | 38.5 wt. %, |
| MgO | 6.2 wt. %, |
| Point 3 | |
| CaO | 36.9 wt. %, |
| $Al_2O_3$ | 52.3 wt. %, |
| MgO | 10.8 wt. %, |
| Point 4 | |
| CaO | 31.6 wt. %, |
| $Al_2O_3$ | 64.6 wt. %, |
| MgO | 3.8 wt. %, and |
| Point 5 | |
| CaO | 32.7 wt. %, |

-continued

| | |
|---|---|
| $Al_2O_3$ | 67.3 wt. %, |
| MgO | 0 wt. %, |

i.e., in the region of a melting point of at least 1,600° C., which region is defined by the liquidus curve of 1,600° C. The non-metallic inclusions have therefore a particle size of up to 6 μm.

The present invention was made on the basis of the above-mentioned findings. The Fe-Ni alloy cold-rolled sheet excellent in cleanliness and etching pierceability of the present invention consists essentially of:

| | |
|---|---|
| nickel | from 30 to 45 wt. %, |
| manganese | from 0.1 to 1.0 wt. %, |
| aluminum | from 0.003 to 0.030 wt. %, |

and the balance being iron and incidental impurities, where the respective contents of silicon, chromium, carbon, nitrogen, sulfur, phosphorus, oxygen and non-metallic inclusions as said incidental impurities being:

up to 0.4 wt. % for silicon,
up to 0.1 wt. % for chromium,
up to 0.005 wt. % for carbon,
up to 0.005 wt. % for nitrogen,
up to 0.005 wt. % for sulfur,
up to 0.010 wt. % for phosphorus,
up to 0.002 wt. % for oxygen, and
up to 0.002 wt. % as converted into oxygen for non-metallic inclusions;

said non-metallic inclusions comprising a composition having a particle size of up to 6 μm in a region of a melting point of at least 1,600° C., which region is defined by the liquidus curve of 1,600° C. in the CaO-$Al_2O_3$-MgO ternary phase diagram, and said composition containing at least one of CaO, $Al_2O_3$ and MgO.

The method for manufacturing the Fe-Ni alloy cold-rolled sheet excellent in cleanliness and etching pierceability of the present invention comprises the steps of:

preparing an Fe-Ni molten alloy, containing nickel in an amount within a range of from 30 to 45 wt. %, and subjected to dephosphorization and decarburization;

adding aluminum to said Fe-Ni molten alloy thus prepared, in a ladle made of an MgO-CaO refractory containing CaO in an amount within a range of from 20 to 40 wt. %;

causing said Fe-Ni molten alloy added with aluminum to react, in said ladle, with a CaO-$Al_2O_3$-MgO slag comprising:

| | |
|---|---|
| CaO and $Al_2O_3$ where, the ratio of $CaO/(CaO + Al_2O_3)$ being at least 0.45, | at least 57 wt. %, |
| MgO | up to 25 wt. %, |
| $SiO_2$ | up to 15 wt. %, |
| and oxides of metals having an oxygen affinity lower than that of silicon | up to 3 wt. % in total, |

to deoxidize said Fe-Ni molten alloy;

casting said deoxidized Fe-Ni molten alloy into an ingot; and blooming, hot-rolling and cold-rolling said ingot to manufacture an Fe-Ni alloy cold-rolled sheet containing non-metallic inclusions having a particle size of up to 6 μm in a total amount of up to 0.002 wt. % as converted into oxygen.

The chemical composition of the Fe-Ni alloy cold-rolled sheet excellent in cleanliness and etching pierceability of the present invention is limited within a range as described above for the following reasons.

(1) Nickel

Nickel is an element which exerts an important effect on the thermal expansion coefficient of an Fe-Ni alloy sheet. With a nickel content within a range of from 30 to 45 wt. %, the alloy sheet has a low thermal expansion coefficient. With a nickel content of under 30 wt. %, however, the alloy sheet has an increased thermal expansion coefficient. With a nickel content of over 45 wt. %, on the other hand, the alloy sheet has also an increased thermal expansion coefficient. A shear in color occurs when the Fe-Ni alloy cold-rolled sheet having a high thermal expansion coefficient is used as a material for a shadow mask. The nickel content should therefore be limited within a range of from 30 to 45 wt. %. Inco nickel (the product name of nickel made by International Nickel Co.) or electrolytic nickel is usually used as a nickel material. For the purpose of reducing the cost, Tominet (the product name of nickel made by Tokyo Nickel Co.) containing cobalt may be used. Although cobalt is contained in an amount of up to 1 wt. % in this case, there is no problem so far as a nickel content is within the above-mentioned range.

(2) Manganese

Manganese has a function of improving hot workability of an Fe-Ni alloy sheet. With a manganese content of under 0.1 wt. %, however, a desired effect as described above is not available. With a manganese content of over 1.0 wt. %, on the other hand, the alloy sheet has an excessively increased hardness and is not suitable as a material for a shadow mask. The manganese content should therefore be limited within a range of from 0.1 to 1.0 wt. %.

(3) Aluminum

Aluminum is an element which exerts an important effect on the amount of non-metallic inclusions and the particle size thereof in an Fe-Ni alloy sheet. With an aluminum content within a range of from 0.003 to 0.030 wt. %, non-metallic inclusions having a small particles size are produced in a slight amount in the alloy sheet. With an aluminum content of under 0.003 wt. %, however, non-metallic inclusions, which has a large particle size, a low melting point and a high malleability, are produced in a large amount and are present in a linear form in the cold-rolled sheet. This results in the production of a defect during the etching-piercing of the alloy sheet. With an aluminum content of over 0.030 wt. %, on the other hand, blackening treatability of the alloy sheet decreases. The aluminum content should therefore be limited within a range of from 0.003 to 0.030 wt. %.

(4) Silicon

Silicon is one of impurities inevitably entrapped into an Fe-Ni alloy. While the silicon content should preferably be the lowest possible, it is difficult from the economic point of view to largely reduce the silicon content in an industrial scale. With a silicon content of over 0.4 wt. %, however, the etching liquid is contaminated during the etching-piercing of the Fe-Ni alloy sheet, resulting in a lower productivity. The silicon content should therefore be limited to up to 0.4 wt. %.

(5) Chromium

Chromium is one of impurities inevitably entrapped into an Fe-Ni alloy. While the chromium content should preferably be the lowest possible, it is difficult from the economic point of view to largely reduce the chromium content in an industrial scale. With a chromium content of over 0.1 wt. %, however, the etching-piercing speed of the Fe-Ni alloy sheet becomes lower, resulting in a lower productivity, and thermal expansion coefficient of the alloy sheet becomes higher, thus producing a shear in color. The chromium content should therefore be limited to up to 0.1 wt. %.

(6) Carbon

Carbon is one of impurities inevitably entrapped into an Fe-Ni alloy. While the carbon content should preferably be the lowest possible, it is difficult from the economic point of view to largely reduce the carbon content in an industrial scale. With a carbon content of over 0.005 wt. %, however, iron carbides are produced in a large amount in the Fe-Ni alloy sheet, thus impairing etching pierceability of the alloy sheet, and this may cause a piercing defect. With a carbon content of over 0.005 wt. %, furthermore, press formability of the alloy sheet decreases. The carbon content should therefore be limited to up to 0.005 wt. %.

(7) Nitrogen

Nitrogen is one of impurities inevitably entrapped into an Fe-Ni alloy. While the nitrogen content should preferably be the lowest possible, it is difficult from the economic point of view to largely reduce the nitrogen content in an industrial scale. With a nitrogen content of over 0.005 wt. %, however, metal nitrides are produced in large amounts in the Fe-Ni alloy sheet, thus impairing etching pierceability of the alloy sheet, and this may cause a piercing defect. The nitrogen content should therefore be limited to up to 0.005 wt. %.

(8) Sulfur

Sulfur is one of impurities inevitably entrapped into an Fe-Ni alloy. While the sulfur content should preferably be the lowest possible, it is difficult from the economic point of view to largely reduce the sulfur content in an industrial scale. With a sulfur content of over 0.005 wt. %, however, sulfide non-metallic inclusions are produced in a large amount in the Fe-Ni alloy sheet, thus impairing etching pierceability of the alloy sheet, and this may cause a piercing defect. The sulfur content should therefore be limited to up to 0.005 wt. %.

(9) Phosphorus

Phosphorus is one of impurities inevitably entrapped into an Fe-Ni alloy. While the phosphorus content should preferably be the lowest possible, it is difficult from the economic point of view to largely reduce the phosphorus content in an industrial scale. With a phosphorus content of over 0.010 wt. %, however, hot workability of the Fe-Ni alloy sheet is seriously deteriorated. The phosphorus content should therefore be limited to up to 0.010 wt. %.

(10) Oxygen

Oxygen is one of impurities inevitably entrapped into an Fe-Ni alloy. While the oxygen content should preferably be the lowest possible, it is difficult from the economic point of view to largely reduce the oxygen content in an industrial scale. With an oxygen content of over 0.002 wt. %, however, oxide non-metallic inclusions are produced in a large amount in the Fe-Ni alloy sheet, thus impairing etching pierceability of the alloy sheet, and this may cause a piercing defect. The oxygen content should therefore be limited to up to 0.002 wt. %.

(11) Non-Metallic Inclusions

Non-metallic inclusions are one of impurities inevitably entrapped into an Fe-Ni alloy sheet. The non-metallic inclusions mainly comprise calcium oxide (CaO), aluminum oxide ($Al_2O_3$) and magnesium oxide (MgO) and exert an important effect on etching pierceability of an Fe-Ni alloy sheet. When the content of the non-metallic inclusions is over 0.002 wt. % as converted into oxygen, etching pierceability of the alloy sheet is impaired and this may cause a piercing defect. The content of the non-metallic inclusions should therefore be limited to up to 0.002 wt. % as converted into oxygen. When the non-metallic inclusions in the alloy sheet comprise a composition in a region other than that surrounded, in the $CaO$-$Al_2O_3$-$MgO$ ternary phase diagram shown in FIG. 2, by the line connecting sequentially the Points 1, 2, 3, 4 and 5, i.e., in the region of a melting point of at least 1,600° C., which region is defined by the liquidus curve of 1,600° C. (i.e., the thick solid line in FIG. 2), the non-metallic inclusions have a particle size of up to 6 μm, and the Fe-Ni alloy cold-rolled sheet exhibits an excellent etching pierceability. The non-metallic inclusions should therefore comprise the composition in the region outside the region which is surrounded by the line connecting sequentially the Points 1, 2, 3, 4 and 5 in the $CaO$-$Al_2O_3$-$MgO$ ternary phase diagram shown in FIG. 2.

When refining an Fe-Ni molten alloy in a ladle according to the present invention, a ladle made of an MgO-CaO refractory containing CaO within a range of from 20 to 40 wt. % is used for the following reasons:

(1) With a CaO content in the refractory of under 20 wt. %, the penetration depth of the slag into the refractory is so large that the refractory is deteriorated. A CaO content of over 40 wt. % leads, on the other hand, to a lower melting point of the refractory and a larger worn ratio, and makes it impossible to accomplish the slag refining of the molten alloy for a long period of time at a high temperature. The CaO content in the refractory should therefore be limited within a range of from 20 to 40 wt. %.

Figure 4:
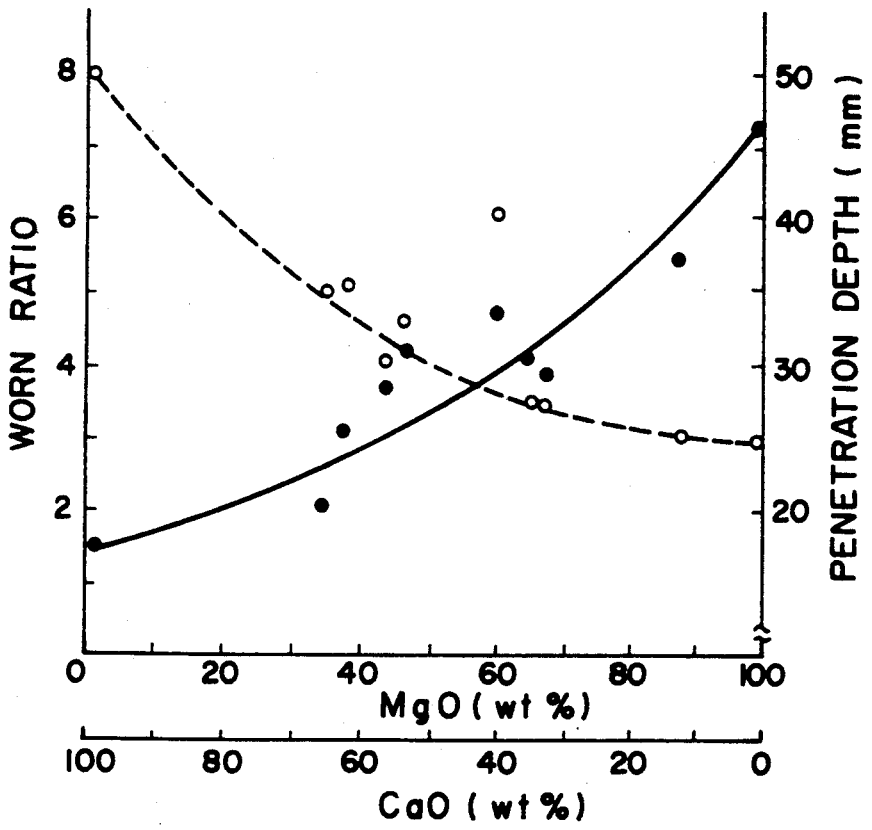
FIG. 4 is a graph illustrating the relationship between the CaO content in a MgO-CaO refractory forming a ladle, the worn ratio of said refractory and the penetration depth of a slag into said refractory.

The above description is explained below more in detail with reference to FIG. 4. In FIG. 4, the plot "●" indicates the penetration depth of the slag, and the solid line represents the penetration depth curve thereof; the plot "○" indicates the worn ratio of the refractory, and the broken line represents the worn ratio curve thereof. In FIG. 4, the ordinate indicates the penetration depth and the worn ratio, and the abscissa indicates the contents of MgO and CaO. More specifically, the upper scale of the abscissa indicates the MgO content of from 0 to 100 wt. %, and the lower scale thereof indicates the CaO content of from 100 to 0 wt. %. The abscissa indicates therefore that the total content of MgO and CaO is always 100 wt. %. For example, when the MgO content is 100 wt. %, the CaO content is accordingly 0 wt. %, and when the MgO content is 20 wt. %, the CaO content is accordingly 80 wt. %. As is clear from FIG. 4, a CaO content within a range of from 20 to 40 wt. % causes a small penetration depth of the slag and a small worn ratio of the refractory.

(2) The ladle made of the MgO-CaO refractory, being low in contents of such oxides as $Fe_2O_3$, $SiO_2$ and $Cr_2O_3$, which are the sources of the alloy oxides, can maintain the oxygen concentration in the molten alloy at a low level and thus can prevent the pickup of silicon and chromium. The ladle made of the MgO-CaO refractory should therefore be used.

When refining an Fe-Ni molten alloy in a ladle according to the present invention, a $CaO-Al_2O_3-MgO$ slag comprising:

| | |
|---|---|
| CaO and $Al_2O_3$ where, the ratio of $CaO/(CaO + Al_2O_3)$ being at least 0.45, | at least 57 wt. %, |
| MgO | up to 25 wt. %, |
| $SiO_2$ | up to 15 wt. %, |
| and oxides of metals having an oxygen affinity lower than that of silicon | up to 3 wt. % in total, |

is used for the following reasons:

(1) With a ratio of $CaO/(CaO+Al_2O_3)$ of under 0.45, the activity of $Al_2O_3$ ($a_{Al_2O_3}$) in the slag exceeds 0.5. When the activity of $Al_2O_3$ in the slag is over 0.5, the deoxidizing power of aluminum decreases if the aluminum content is kept constant. The ratio of $CaO/(CaO+Al_2O_3)$ should therefore be limited to at least 0.45.

Figure 5:
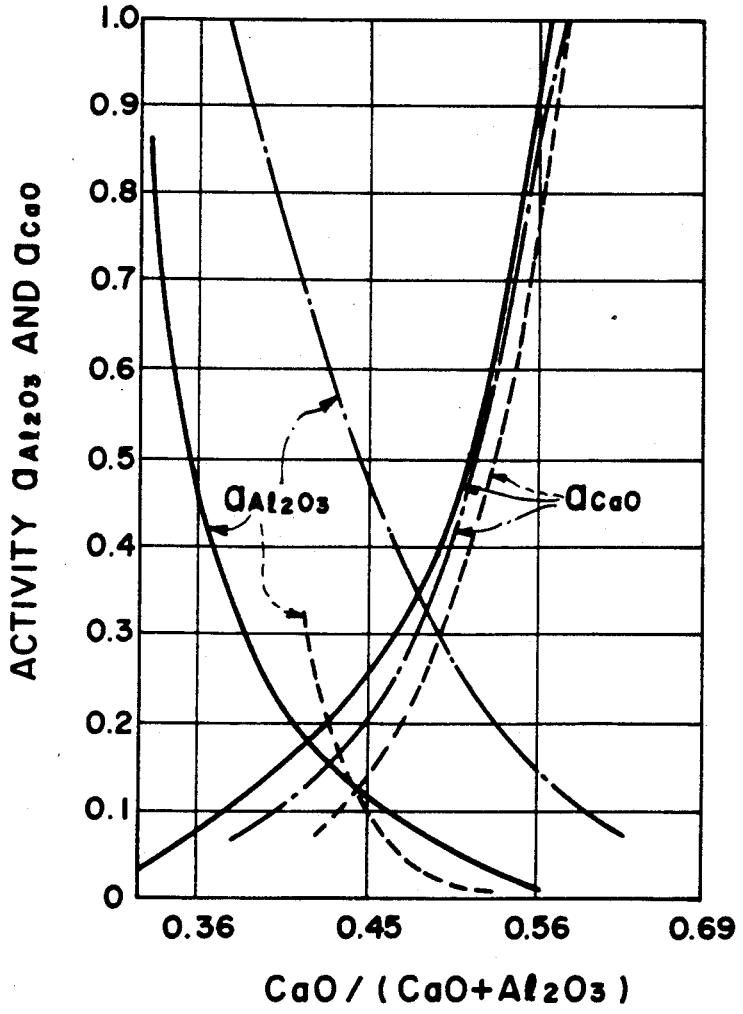
FIG. 5 is a graph illustrating the relationship between the activity of each of $Al_2O_3$ and CaO in a CaO-$Al_2O_3$-MgO slag, and the ratio of CaO/(CaO+$Al_2O_3$)

The above description is explained below more in detail with reference to FIG. 5. FIG. 5 is a graph illustrating the relationship between the activity of each of $Al_2O_3$ and CaO in a $CaO-Al_2O_3-MgO$ slag, and the ratio of $CaO/(CaO+Al_2O_3)$. The ordinate indicates the activity of each of $Al_2O_3$ and CaO ($a_{Al_2O_3}$ and $a_{CaO}$), and the abscissa indicates the ratio of $CaO/(CaO+Al_2O_3)$. FIG. 5 also illustrates three generally known iso-activity curves of $Al_2O_3$ and CaO. As is clear from FIG. 5, with a ratio of $CaO/(CaO+Al_2O_3)$ of at least 0.45, the activity of $Al_2O_3$ ($a_{Al_2O_3}$) is restrained to up to 0.5 for any iso-activity curves of $Al_2O_3$. As a result, with a ratio of $CaO/(CaO+Al_2O_3)$ of at least 0.45, a slag having a strong deoxidizing power of aluminum is available.

(2) When the MgO content is the slag is over 25 wt. %, the melting point of the slag increases, and the reaction of the slag with the Fe-Ni molten alloy decreases. The MgO content should therefore be limited to up to 25 wt. %.

(3) When the $SiO_2$ content in the slag is over 15 wt. %, the activity of $SiO_2$ ($a_{SiO_2}$) in the slag increases, and the amount of oxygen in the Fe-Ni molten alloy increases under the effect of $SiO_2$. As a result, the oxygen content present in the Fe-Ni alloy cold-rolled sheet becomes over 0.0020 wt. %. The $SiO_2$ content should therefore be limited to up to 15 wt. %.

(4) When the total amount of oxides of metals having an oxygen affinity lower than that of silicon is over 3 wt. % in the slag, the oxygen content present in the Fe-Ni alloy cold-rolled sheet becomes over 0.0020 wt. %. The total amount of oxides of metals having an oxygen affinity lower than that of silicon should therefore be limited to up to 3 wt. %, and more preferably, to up to 1.5 wt. %.

Figure 6:
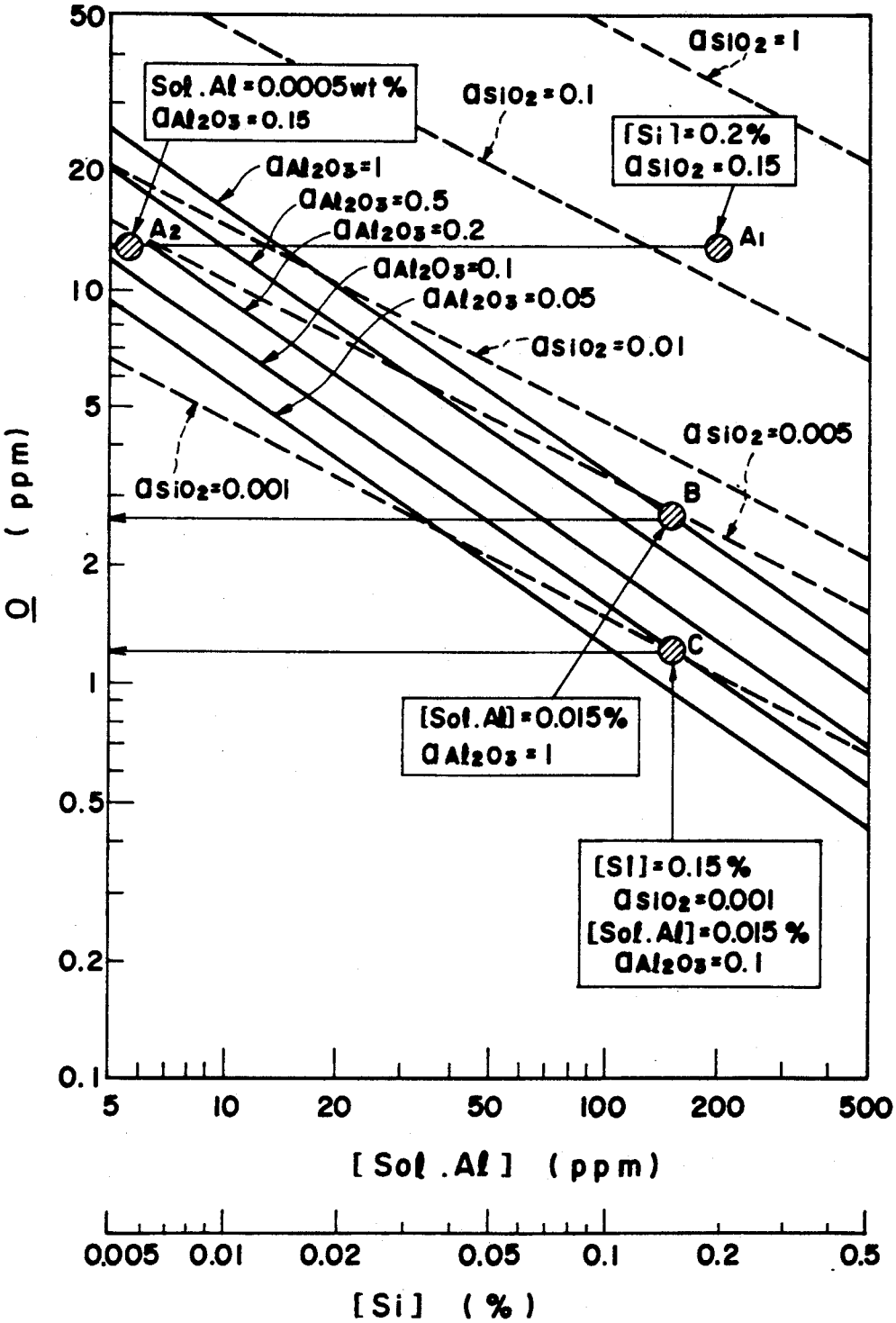
FIG. 6 is a graph illustrating the relationship between the residual silicon level in the "Si-deoxidation equilibrium" or the residual aluminum level in the "Al-deoxidation equilibrium", on the one hand, and the equilibrated residual oxygen level, on the other hand, in an Fe-Ni molten alloy at a temperature of 1,550° C. containing 36 wt. % nickel.

In addition, the reasons of availability of an Fe-Ni alloy cold-rolled sheet excellent in cleanliness by deoxidizing the Fe-Ni molten alloy by the use of the above-mentioned slag are described below with reference to FIG. 6. FIG. 6 is a graph illustrating, when the deoxidation by means of aluminum or silicon reaches the equilibrium state in an Fe-Ni molten alloy at a temperature of 1,550° C. containing nickel in an amount of 36 wt. %, the relationship between the residual content in the molten alloy of aluminum or silicon used for deoxidation, on the one hand, and the residual content of oxygen in the molten alloy, on the other hand. In FIG. 6, the ordinate represents the residual content of oxygen in the molten alloy, and the abscissa indicates the residual content of aluminum or silicon in the molten alloy. In FIG. 6, furthermore, the oblique solid line represents the iso-activity curve of $Al_2O_3$, and the oblique broken line indicates the iso-activity curve of $SiO_2$. Also in FIG. 6, the mark "C" represents the residual content of silicon or aluminum and the residual content of oxygen in the molten alloy of the present invention in which the above-mentioned slag of the present invention is used to deoxidize the molten alloy, and each of the marks "A" ($A_1$ and $A_2$) and "B" represents the residual content of silicon or aluminum and the residual content of oxygen in the molten alloys deoxidized by a method outside the scope of the present invention (hereinafter referred to as the "deoxidizing method for comparison") No. 1 or 2, in which the slag of the present invention is not used.

As is evident from FIG. 6, the residual content of oxygen is low in the molten alloy of the present invention. In other words, by strongly stirring the molten alloy under the presence of aluminum in a sufficient amount and the above-mentioned slag, the respective activities $a_{Al_2O_3}$ and $a_{SiO_2}$ in the equilibrium state are reduced, and simultaneously the oxygen concentration in the equilibrium state is stabilized at a lower level. Thus, the non-metallic inclusions comprising oxides in the molten alloy are absorbed into the slag and removed. As a result, it is possible to clean the molten alloy and thus to cause the non-metallic inclusions having a high melting point and a very small particle size in a very small amount to disperse throughout the molten alloy.

In blooming the Fe-Ni alloy ingot, the reduction ratio should preferably be at least 70% and the rolling temperature should preferably be within a range of from 1,150° to 1,250° C. The reasons therefor are as follows:

(1) A reduction ratio of at least 70% has an effect of pulverizing the alloy structure and the non-metallic inclusions in the alloy, and thus achieving a very small particle size of the non-metallic inclusions in the cold-rolled sheet. The reduction ratio should therefore be limited to at least 70%.

(2) At a rolling temperature of under 1,150° C., it is difficult to accomplish blooming. At a rolling temperature of over 1,250° C., on the other hand, deformation resistance of the matrix metal decreases, thus making it difficult to pulverize the non-metallic inclusions. The rolling temperature should therefore be limited within a range of from 1,150° to 1.250° C.

Now, the Fe-Ni alloy cold-rolled sheet excellent in cleanliness and etching pierceability and the method for manufacturing same of the present invention are described below more in detail by means of an example while comparing with an example for comparison outside the scope of the present invention.

EXAMPLE

With the use of raw materials as shown in Table 1, an Fe-Ni alloy cold-rolled sheet was prepared through the following manufacturing processes:

1. Refining using the converter,
2. Refining using the VAD (abbreviation of vacuum-arc-degassing) facilities, including:
   Dephosphorization refining,
   Nickel melting,
3. Refining using the VOD (abbreviation of vacuum-oxygen-decarburization) facilities, including:
   Oxygen-feeding-decarburization,
   Vacuum-decarburization,
   Slag-deoxidation,
4. Ingot casting,
5. Blooming,
6. Hot-rolling,
7. Cold-rolling.

TABLE 1

(Raw material and Timing of use thereof)

| Kind of raw material | Purity of raw material | Consumption by timing (Kg) During VAD | During VOD | Total |
|---|---|---|---|---|
| Alloy material | | | | |
| Molten steel | | 20,000 | — | 20,000 |
| Ni lump | 99.9% Ni | 9,500 | 700 | 10,200 |
| Mn lump | 99.9% Mn | — | 70 | 70 |
| Ferrosilicon | 75.0% Si, low Al | — | 80 | 80 |
| Al lump | 97.0% Al | — | 275 | 275 |
| Auxiliary raw material | | | | |
| Calcined lime | 98.0% CaO | 850 | 700 | 1,550 |
| Fluorspar | 80.0% $CaF_2$ | 200 | 260 | 460 |
| Alumina | | 50 | — | 50 |
| Iron ore | | 50 | — | 50 |

Figure 7A:
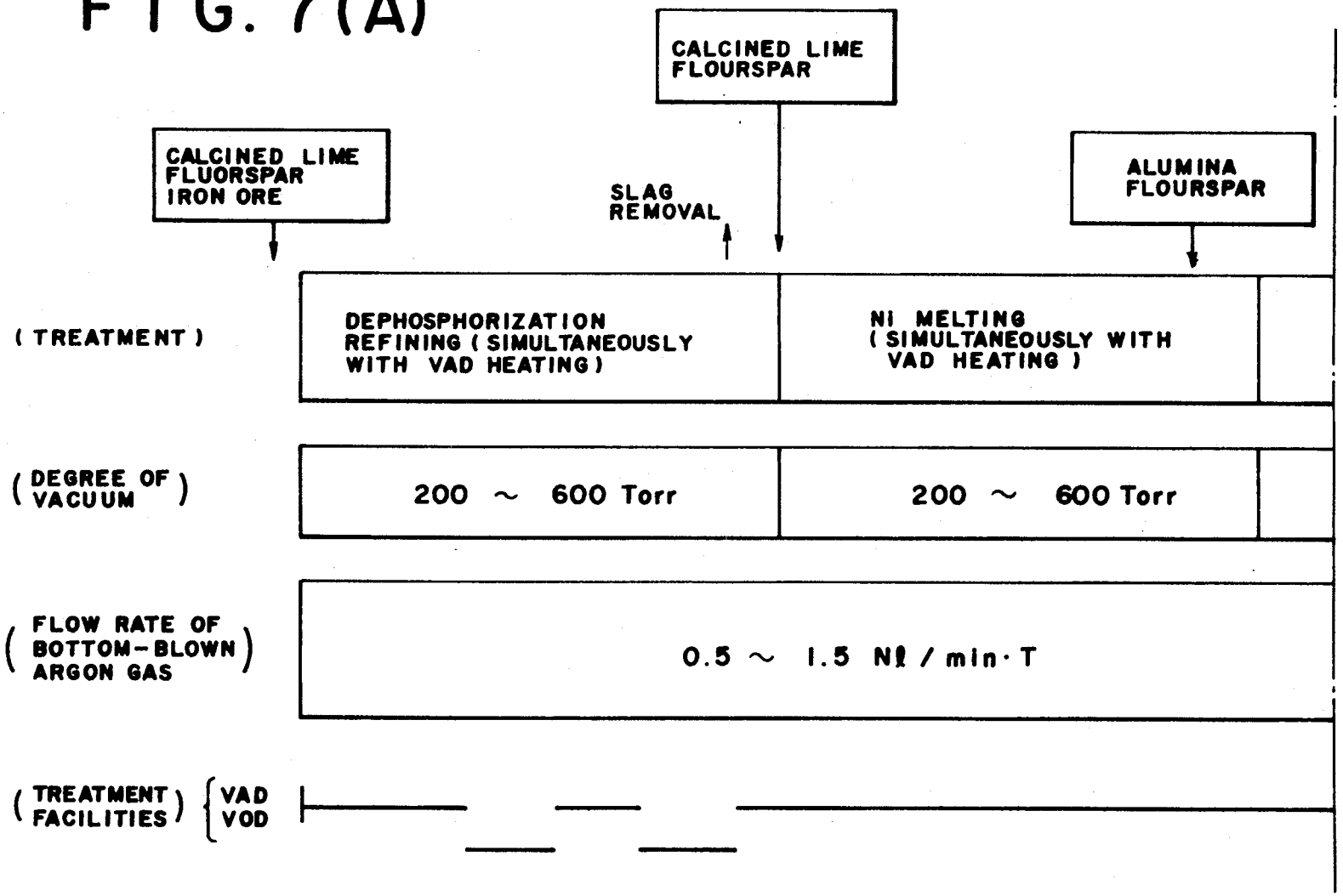
FIGS. 7(A) and 7(B) are flow diagrams illustrating an embodiment of the process for refining an Fe-Ni molten alloy in a ladle according to the present invention.
Figure 7B:
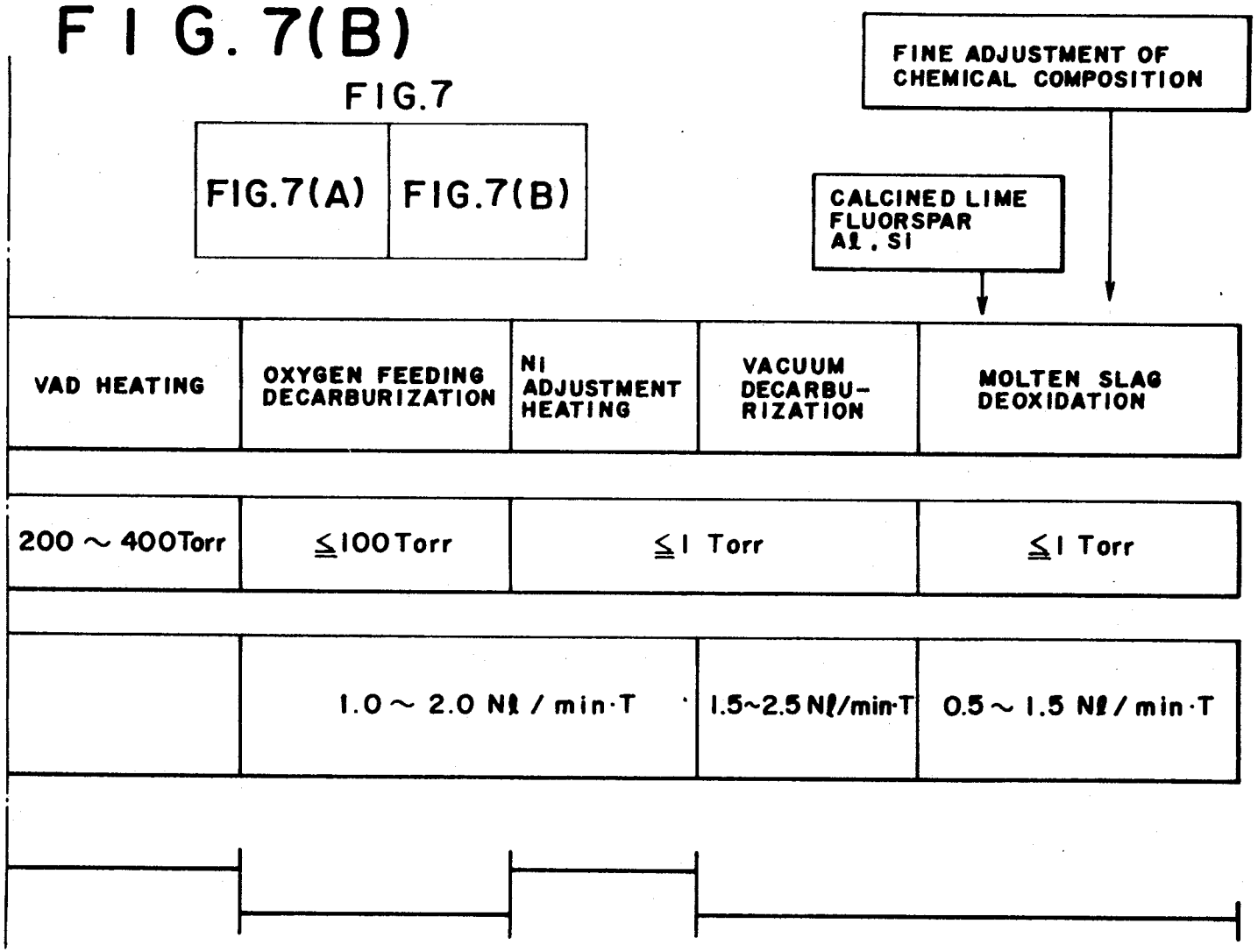
Figure 8A:
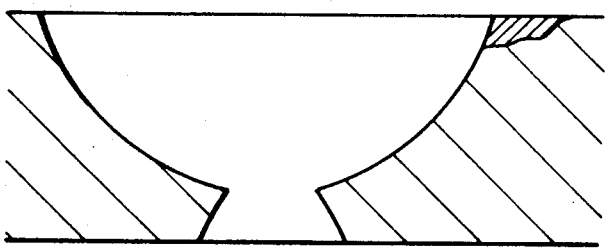
FIGS. 8(A), 8(B), 8(C) and 8(D) are schematic descriptive views illustrating the state of a defect which occurs during the etching-piercing of an Fe-Ni alloy sheet.
Figure 8B:
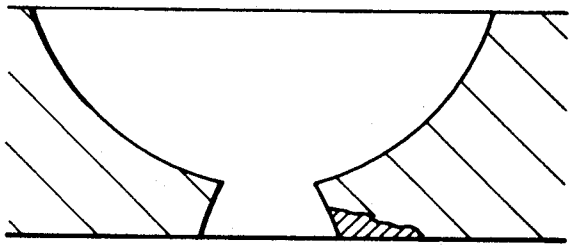
Figure 8C:
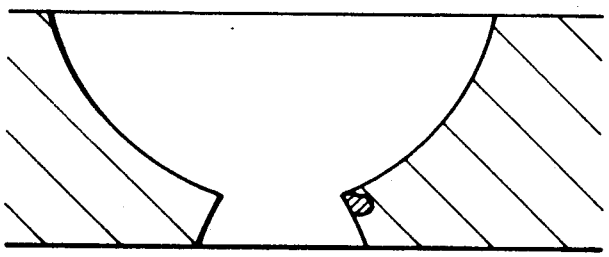
Figure 8D:
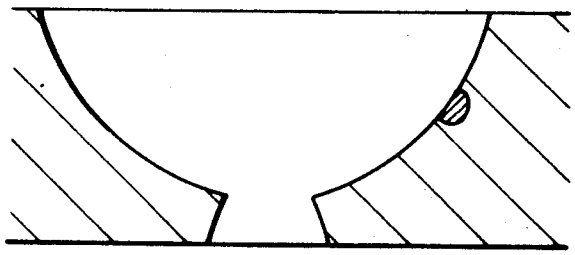

The refining processes using the above-mentioned VAD and VOD facilities are illustrated in FIG. 7.

A dephosphorized molten pig iron was refined in a 250-ton top-blowing converter equipped with a bottom porous plug for blowing a stirring gas, to obtain a molten steel not as yet deoxidized, which was then transferred into a 250-ton ladle. Of the 250-tons of the thus obtained molten steel, 20-tons were then received in a 50-ton ladle from the 250-ton ladle. The above-mentioned molten steel had the following chemical composition:

| Mn | Cu | Mo | Cr | C | S | P | Fe |
|---|---|---|---|---|---|---|---|
| | | | | (wt. %) | | | |
| 0.10 | 0.01 | 0.01 | 0.05 | 0.03 | 0.003 | 0.003 | Balance |

The above-mentioned molten steel in an amount of 20 tons was poured through a rotary nozzle into another 20-ton ladle lined with magnesia-dolomite bricks comprising 57.2 wt. % MgO, 38.4 wt. % CaO, 1.6 wt. % $SiO_2$ and 0.2 wt. % $Al_2O_3$. The ladle was then placed in the VAD (vacuum-arc-degassing) facilities, in which the molten steel was dephosphorized. Absorption of nitrogen into the molten steel was prevented by using such a molten steel not as yet deoxidized. Then, after the removal of slag, lumps of pure nickel and a nickel alloy were charged into the ladle to melt same under the following conditions while heating the molten steel in the ladle to a temperature of at least 1,600° C. by means of a three-phase electrode heating device under a reduced pressure:

| | |
|---|---|
| Degree of vacuum | from 200 to 600 Torr, |
| Flow rate of bottom-blown argon gas | from 0.5 to 1.5 Nl/min.ton, |
| Timing of addition of flux | immediately before the start of VAD refining, |
| Composition of flux | |
| Calcined lime | 15 Kg/ton, |
| Fluorspar | 4 kg/ton. |

After the melting of nickel, the thus obtained Fe-Ni molten alloy in the ladle, which was now increased in quantity to about 30 tons, was further heated to a temperature of at least 1,700° C., and more preferably, at least 1,750° C. under the following conditions:

| | |
|---|---|
| Degree of vacuum | from 200 to 400 Torr, |
| Flow rate of bottom-blown argon gas | from 0.5 to 1.5 Nl/min.ton, |
| Addition of flux | none. |

Investigation of carbon and nickel contents in the Fe-Ni molten alloy at this stage gave the following result:

| C | Ni |
|---|---|
| (wt. %) | |
| 0.004 | 34.32 |

The above-mentioned heating of the molten alloy after the melting of nickel eliminated the necessity of the heating after the completion of refining using the VOD (vacuum-oxygen-decarburization) facilities as the next step.

Then, the ladle was transferred into the VOD facilities, where the Fe-Ni molten alloy was decarburized. This decarburization of the molten alloy comprised a decarburization effected while blowing oxygen through a top-blowing lance (hereinafter referred to as the "oxygen-feeding decarburization by the top blowing lance") and a vacuum decarburization under a reduced pressure.

First, the oxygen-feeding decarburization by the top-blowing lance was carried out under the following conditions:

| | |
|---|---|
| Degree of vacuum | 100 Torr or under, |
| Flow rate of bottom-blown argon gas | from 1.0 to 2.0 Nl/min.ton, |
| Flow rate of top-blown oxygen gas | from 8 to 20 $Nm^3$/min.ton, |
| Oxygen feed | from 2 to 5 $Nm^3$/ton, |
| Distance between lance and molten alloy surface | from 700 to 900 mm, |
| Addition of flux | none. |

The resultant oxygen-enriched Fe-Ni molten alloy was decarburized under the reduced pressure until the carbon content therein was decreased to 0.005 wt. % or under by accelerating the carbon-oxygen reaction while stirring the molten alloy by means of the bottom-blown argon gas. Toward the end of the above-mentioned oxygen-feeding decarburization by the top-blowing lance, the ladle was transferred again to the VOD facilities, and nickel was added to the molten alloy to finely adjust the nickel content in the nolten alloy, and the temperature of the molten alloy was adjusted to about 1,750° C. At this stage, the molten alloy had the following contents of nickel, carbon and nitrogen:

| | wt. % | |
|---|---|---|
| Ni | C | N |
| 36.2 | 0.003 | 0.0028 |

Then, the vacuum decarburization under the reduced pressure was carried out under the following conditions:

| | |
|---|---|
| Degree of vacuum | 1 Torr or under, |
| Flow rate of bottom-blown argon gas | from 1.5 to 2.5 Nl/min.ton, |
| Addition of flux | none |
| Temperature of molten alloy at the start of vacuum decarburization | 1,745° C. |

As a result, it was possible to decarburize the Fe-Ni molten alloy until the carbon content therein was decreased to 0.0009 wt. % or under.

Then, the Fe-Ni molten alloy was deoxidized under the following conditions through reaction between the molten alloy and the slag, by adding a deoxidizer such as aluminum and a flux to the molten alloy also in the VOD facilities and while strongly stirring the molten alloy by means of the bottom-blown argon gas (hereinafter referred to as the "deoxidizing method of the invention");

| | |
|---|---|
| Degree of vacuum | 1 Torr or under, |
| Flow rate of bottom-blown argon gas | from 0.5 to 2.5 Nl/min.ton, |
| Addition of flux and deoxidizer (twice): | |
| First addition | |
| Composition of flux | |
| Calcined lime | 30 Kg/t, |
| Fluorspar | 5 Kg/t, |
| Composition of deoxidizer | |
| Aluminum | 10 Kg/t, |
| Ferro silicon | 2 Kg/t, |
| Timing of addition | immediately before the start of deoxidizing refining. |
| Second addition | |
| Composition of additive | fine adjustment agent of molten alloy chemical composition, |
| Timing of addition | in the middle of deoxidizing refining. |

The contents of silicon and soluble aluminum in the Fe-Ni molten alloy before deoxidation of the molten alloy by the slag were as follows:

| (wt. %) | |
|---|---|
| Si | Sol.Al |
| Up to 0.4 | from 0.002 to 0.030 |

The above-mentioned $CaO$-$Al_2O_3$-$MgO$ slag, which was caused to react with the molten alloy, had the following particulars:

| (a) Chemical composition: (wt. %) | | | | | | |
|---|---|---|---|---|---|---|
| CaO | $SiO_2$ | $Al_2O_3$ | MgO | MnO | $Cr_2O_3$ | T.Fe |
| 51.99 | 6.33 | 20.44 | 19.26 | 0.18 | 0.41 | 0.78 |

(b) The ratio of $CaO/(CaO+Al_2O_3)$ 0.72.

(c) The total content of oxides of metals having an oxygen affinity lower than that of silicon (i.e., $T.Fe+MnO+Cr_2O_3$) 1.4 wt. %

The result of the above-mentioned deoxidation refining of the Fe-Ni molten alloy in the VOD facilities was as follows:

| | |
|---|---|
| Silicon content in the molten alloy | from 0.1 to 0.3 wt. %, |
| Estimated activity of $SiO_2$ ($a_{SiO_2}$) | from 0.001 to 0.005, |
| Soluble aluminum content in the molten alloy | from 0.005 to 0.030 wt. %, |
| Estimated activity of $Al_2O_3$ ($a_{Al_2O_3}$) | from 0.1 to 0.3, |
| Estimated concentration of equilibrated oxygen | 1 ppm, and |
| Observed T.oxygen content in the molten alloy | from 10 to 15 ppm. |

Furthermore, since the above-mentioned deoxidation of the Fe-Ni molten alloy through the reaction between the molten alloy and the slag was carried out under a high degree of vacuum while strongly stirring the molten alloy, absorption of nitrogen into the molten alloy could be prevented.

The above-mentioned deoxidation of the Fe-Ni molten alloy by means of the slag was carried out without the application of arc heating so as to prevent pickup of carbon.

At this stage, the Fe-Ni molten alloy had the following chemical composition:

| (wt. %) | | | | | |
|---|---|---|---|---|---|
| Ni | Mn | Sol.Al | Si | Cr | C |
| 35.76 | 0.29 | 0.007 | 0.06 | 0.08 | 0.0015 |
| N | S | P | Cu | Mo | |
| 0.0012 | 0.001 | 0.002 | 0.01 | 0.01 | |

Then, after the completion of the treatment in the VAD and VOD facilities, the Fe-Ni molten alloy was cast into an ingot by the bottom-casting method with the use of a big-end-up 7-ton or 5-ton mold under the following conditions:

| | |
|---|---|
| (1) Temperature of pouring flow | from 1,490 to 1,525° C., |
| (2) Casting speed | from 150 to 190 mm/minute, |
| (3) Sealing condition | the space between the ladle nozzle and the pouring pipe was surrounded by a cover, and argon gas was fed at a rate of 130 $Nm^3$/hour. |

Because the pouring flow was completely sealed from the open air with argon gas, the oxygen concentration within the cover was kept to up to 0.1% after the lapse of two minutes from the start of casting. As a result, reoxidation of the molten alloy or absorption of nitrogen into the molten alloy caused by the entanglement of air could consequently be prevented.

The Fe-Ni molten alloy sampled from the above-mentioned pouring flow had the following chemical composition:

| (wt. %) | | | | | |
|---|---|---|---|---|---|
| Ni | Mn | Sol.Al | Si | Cr | C |
| 35.78 | 0.30 | 0.007 | 0.06 | 0.08 | 0.0017 |
| N | S | P | Mo | T.O | Fe |
| 0.0012 | 0.0005 | 0.002 | 0.01 | 0.0015 | Balance |

For the purpose of investigating cleanliness of the thus prepared alloy ingot, the non-metallic inclusions in the solid at a runner of the bottom-casted ingot were SEM (abbreviation of scanning electronic microscope)-analyzed. The results are shown in Table 2 and FIG. 3.

TABLE 2

(Chemical composition of non-metallic inclusions)

| Test piece No. | Chemical composition of non-metallic inclusions (wt. %) CaO | $Al_2O_3$ | MgO | Total (wt. %) |
|---|---|---|---|---|
| 1 | 65 | 35 | — | 100 |
| 2 | 55 | 5 | 40 | 100 |
| 3 | 15 | 60 | 25 | 100 |
| 4 | 10 | — | 90 | 100 |
| 5 | 25 | 5 | 70 | 100 |

The solid at the runner of the bottom casted ingot had the following contents of soluble aluminum, nitrogen and oxygen:

| Sol.Al | N | T.O |
|---|---|---|
| 0.008 | 0.0012 | 0.0013 |

Figure 3:
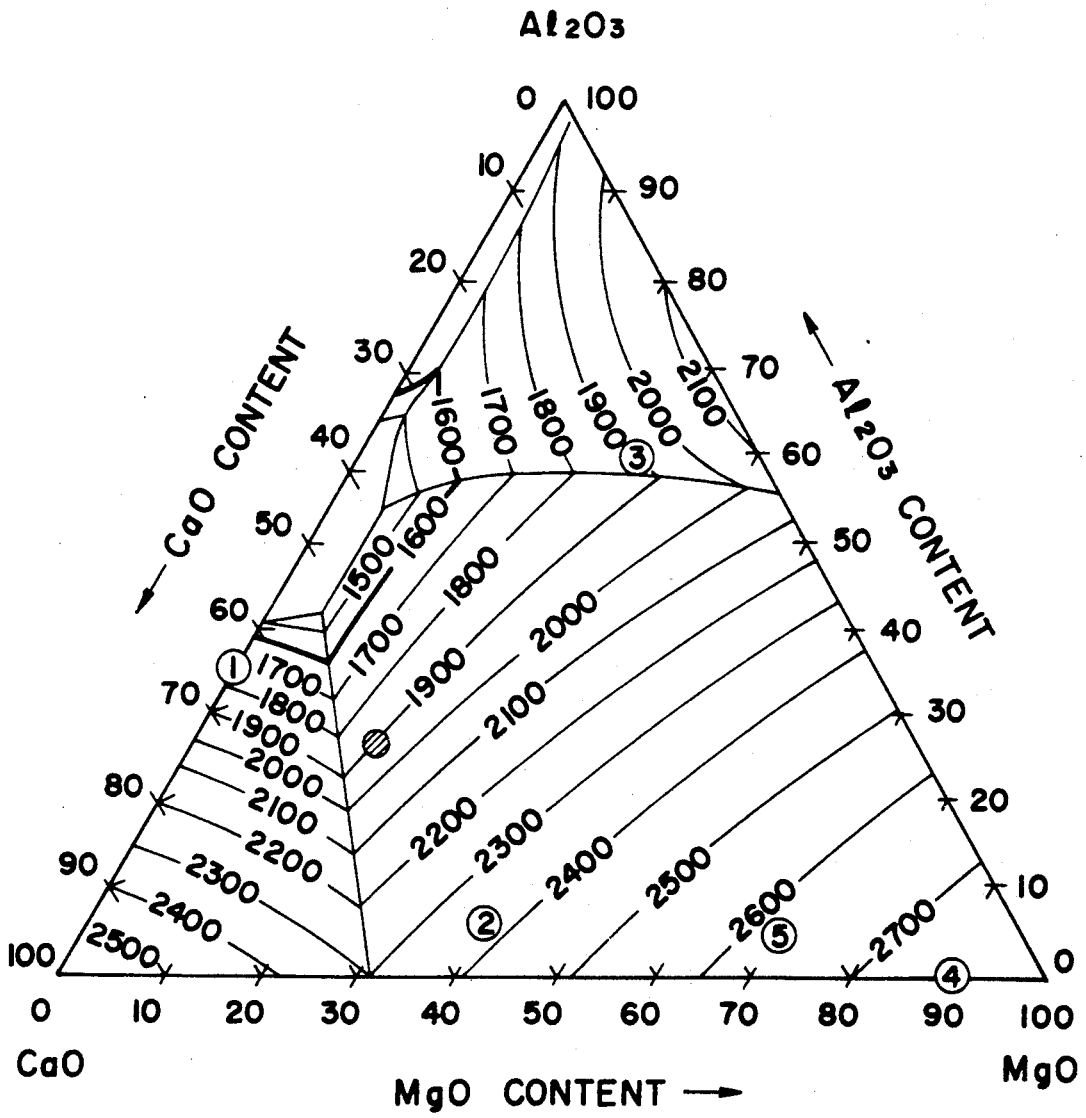
FIG. 3 is the CaO-$Al_2O_3$-MgO ternary phase diagram illustrating the composition of non-metallic inclusions present in the Fe-Ni alloy cold-rolled sheet in an embodiment of the present invention.

As is clear from Table 2 and FIG. 3, the composition of the non-metallic inclusions in the test pieces Nos. (1) to (5) of the solid at the runner of the Fe-Ni alloy ingot of the present invention showed values within a region of a melting point of at least 1,600° C., which region is defined by the liquidus curve of 1,600° C. in the CaO-$Al_2O_3$-MgO ternary phase diagram, as shown in FIG. 3 in all cases.

Then, the thus prepared ingot was bloomed at a reduction ratio of at least 70% and at a temperature within a range of from 1,150° to 1,250° C., and then subjected to sequential processes comprising a slab surface conditioning, a hot rolling, a descaling, a cold rolling, an annealing, a cold rolling and a stress relief heat treatment, to prepare samples of the Fe-Ni alloy cold-rolled sheet having a thickness of 0.15 mm (hereinafter referred to as the "samples of the invention") Nos. 1 and 2, as shown in Table 1.

The samples of the invention Nos. 1 and 2 had the following contents of manganese, silicon, sulfur, nitrogen and oxygen:

| (wt. %) | | | | |
|---|---|---|---|---|
| Mn | Si | S | N | T.O |
| 0.29 | 0.05 | 0.0005 | 0.0012 | 0.0013 |

Furthermore, the distribution of manganese, silicon, sulfur, nitrogen and oxygen at the top and bottom ends of each of the samples of the invention Nos. 1 and 2 was investigated. The result was as follows:

| Sample of the invention | (wt. %) Mn | Si | S | N | T.O |
|---|---|---|---|---|---|
| No. 1 | | | | | |
| Top end | 0.29 | 0.05 | 0.0003 | 0.0012 | 0.0016 |
| Bottom end | 0.29 | 0.05 | 0.0003 | 0.0016 | 0.0014 |
| No. 2 | | | | | |
| Top end | 0.29 | 0.05 | 0.0005 | 0.0013 | 0.0013 |
| Bottom end | 0.29 | 0.05 | 0.0003 | 0.0013 | 0.0016 |

The result shown above reveals that manganese, silicon, sulfur, nitrogen and oxygen in the samples of the invention Nos. 1 and 2 are very uniformly distributed on the practical level.

The samples of the invention Nos. 1 and 2 had the following chemical composition:

| (wt. %) | | | | | |
|---|---|---|---|---|---|
| Ni | Mn | Sol.Al | Si | Cr | C |
| 35.73 | 0.29 | 0.007 | 0.05 | 0.07 | 0.0019 |
| N | S | P | Mo | T.O | Fe |
| 0.0013 | 0.0004 | 0.002 | 0.01 | 0.0014 | Balance |

Then, for comparison purposes, samples of the Fe-Ni alloy cold-rolled sheet outside the scope of the present invention having a thickness of 0.15 mm (hereinafter referred to as the "samples for comparison") Nos. 3 and 4 as shown in Table 3-1, were prepared through the same process as in the present invention described above, except that the deoxidation refining was carried out with the use of silicon and manganese, not using the slag, under a reduced pressure (hereinafter referred to as the "deoxidizing method for comparison No. 1").

According to the deoxidizing method for comparison No. 1, the non-metallic inclusions comprising oxides in the deoxidation refining consisted essentially of $Al_2O_3$, MnO and $SiO_2$, and had a composition within the region of spessartite as shown in FIG. 1, and had a low melting point, and showed a high malleability in the hot rolling.

The result of the above-mentioned deoxidation refining in the deoxidizing method for comparison No. 1 was as follows:

| | |
|---|---|
| Silicon content in the molten alloy | from 0.1 to 0.3 wt. %, |
| Estimated activity of $SiO_2$ ($a_{SiO_2}$) | from 0.1 to 0.2, |
| Soluble aluminum content in the molten alloy | from 0.0004 to 0.0020 wt. %, |
| Estimated activity of $Al_2O_3$ ($a_{Al_2O_3}$) | from 0.15 to 0.25, |
| Estimated concentration of equilibrated oxygen | from 10 to 15 ppm, and |
| Observed T.oxygen content in the molten alloy | from 25 to 35 ppm. |

For comparison purposes, furthermore, another samples of the Fe-Ni alloy cold-rolled sheet outside the scope of the present invention having a thickness of 0.15 mm (hereinafter referred to as the "samples for comparison") Nos. 5 and 6 as shown in Table 3-1, were prepared through the same process as in the present invention as described above, except that the deoxidation refining was carried out with the use of aluminum, not using the slag, under a reduced pressure (hereinafter referred to as the "deoxidizing method for comparison No. 2").

According to the deoxidizing method for comparison No. 2, the non-metallic inclusions comprising oxides in the deoxidization refining consisted essentially of $Al_2O_3$, and had a high melting point, and showed a low malleability in the hot rolling.

The result of the above-mentioned deoxidation refining in the deoxidizing method for comparison No. 2 was as follows:

| | |
|---|---|
| Silicon content in the molten alloy | from 0.1 to 0.3 wt. %, |
| Estimated activity of $SiO_2$ ($aSiO_2$) | from 0.1 to 0.2, |
| Soluble aluminum content in the molten alloy | from 0.005 to 0.030 wt. %, |
| Estimated activity of $Al_2O_3$ ($a_{Al_2O_3}$) | 1 |
| Estimated concentration of equilibrated oxygen | 3 ppm, and |
| Observed T.oxygen content in the molten alloy | from 15 to 20 ppm. |

TABLE 3-1

| | Sample of the invention | | Sample for comparison | | | |
|---|---|---|---|---|---|---|
| Sample No. | 1 | 2 | 3 | 4 | 5 | 6 |
| Chemical composition (wt. %) | | | | | | |
| Ni | 35.7 | 35.5 | 35.8 | 35.7 | 35.6 | 35.7 |
| Mn | 0.28 | 0.29 | 0.28 | 0.50 | 0.29 | 0.45 |
| Sol.Al | 0.014 | 0.007 | 0.001 | 0.001 | 0.010 | 0.007 |
| Si | 0.13 | 0.10 | 0.12 | 0.28 | 0.15 | 0.25 |
| Cr | 0.02 | 0.05 | 0.03 | 0.05 | 0.04 | 0.04 |
| C | 0.0019 | 0.0015 | 0.0020 | 0.0025 | 0.0011 | 0.0014 |
| N | 0.0012 | 0.0013 | 0.0021 | 0.0020 | 0.0015 | 0.0012 |
| S | 0.0006 | 0.0005 | 0.0004 | 0.0005 | 0.0006 | 0.0006 |
| P | 0.002 | 0.002 | 0.002 | 0.002 | 0.001 | 0.001 |
| T.O | 0.0010 | 0.0014 | 0.0040 | 0.0028 | 0.0015 | 0.0020 |
| Thickness (mm) | 0.15 | 0.15 | 0.15 | 0.15 | 0.15 | 0.15 |
| Type of non-metallic inclusions | $CaO—Al_2O_3—MgO$ type | | $SiO_2—MnO—Al_2O_3$ type | | $Al_2O_3$ type | |
| Deoxidizing method | Deoxidizing method of the invention | | Deoxidizing method for comparison No. 1 | | Deoxidizing method for comparison No. 2 | |

As is clear from Table 3-1, the T. oxygen content in the sample was the lowest in the samples of the invention Nos. 1 and 2, followed by the samples for comparison No. 5 and 6, and the highest in the samples for comparison Nos. 3 and 4.

This means, as is clear from FIG. 6, that, in the deoxidizing method of the invention, the concentration of equilibrated oxygen decreases, and the removal of inclusions in suspension through absorption by the slag reduces the T.oxygen content, as compared with the deoxidizing methods for comparison Nos. 1 and 2.

Then, an area of 60 $mm^2$ in a cross-sectional face of thickness in the longitudinal direction in each of the thus prepared samples of the invention Nos. 1 and 2 and the samples for comparison Nos. 3 to 6, was observed by a 800-magnification microscope to measure the width and the length of the non-metallic inclusions present in this area. In this observation, the non-metallic inclusions were classified as follows according to the shape and the size, and the number of non-metallic inclusions present per $mm^2$ was counted:

(a) Non-metallic inclusions having a ratio of length/width of up to 3 (hereinafter referred to as the "spherical non-metallic inclusions"), and (b) Non-metallic inclusions having a ratio of length/width of over 3 (hereinafter referred to as the "linear non-metallic inclusions").

The result of this observation is shown in Table 3-2.

TABLE 3-2

| | | Sample of the invention | | Sample for comparison | | | |
|---|---|---|---|---|---|---|---|
| Sample No. | | 1 | 2 | 3 | 4 | 5 | 6 |
| Number of non-metallic inclusions per $mm^2$ | | | | | | | |
| Width of spherical non-metallic inclusions | Under 3 μm | 8 | 9 | 8 | 9 | 10 | 11 |
| | 3 μm-under 6 μm | 1 | 3 | 1 | 2 | 4 | 6 |
| | 6 μm-under 14 μm | 0 | 0 | 0 | 0 | 1 | 1 |
| | 14 μm or over | 0 | 0 | 0 | 0 | 0 | 0 |
| Width of linear non-metallic inclusions | Under 3 μm | 1 | 1 | 20 | 10 | 1 | 1 |
| | 3 μm-under 5 μm | 0 | 0 | 8 | 5 | 0 | 0 |
| | 5 μm or over | 0 | 0 | 0 | 0 | 0 | 0 |
| Ratio of reject occurrence in etching-piercing (%) | Type (A) | 0 | 0 | 0.04 | 0.05 | 0.07 | 0.15 |
| | Type (B) | 0 | 0 | 0.03 | 0.02 | 0.04 | 0.05 |
| | Type (C) | 0 | 0.01 | 2.35 | 1.30 | 0.50 | 0.82 |
| | Type (D) | 0 | 0.01 | 2.54 | 1.50 | 0.01 | 0.01 |

As shown in Table 3-2, the number of the non-metallic inclusions in the sample of the invention No. 1 was as follows:

| | |
|---|---|
| Number of spherical non-metallic inclusions: | |
| Width of under 3 μm | 8, |
| Width of from 3 to under 6 μm | 1, |
| Number of linear non-metallic inclusions: | |
| Width of under 3 μm | 1, |
| Width of 3 μm or over | none. |

This revealed that, in the sample of the invention No. 1, the non-metallic inclusions mostly comprised spherical ones having a width of up to 3 μm, and hence the non-metallic inclusions had a very small particle size. This was also the case with the sample of the invention No. 2.

On the other hand, the number of the non-metallic inclusions in the sample for comparison No. 3 was as follows:

| | |
|---|---|
| Number of spherical non-metallic inclusions: | |
| Width of under 3 μm | 8, |
| Width of from 3 to under 6 μm | 1, |
| Number of linear non-metallic inclusions: | |
| Width of under 3 μm | 20, |
| Width of 3 μm or over | 8. |

This revealed that, there were many linear non-metallic inclusions in the sample for comparison No. 3, and hence, the non-metallic inclusions had a large particle size. This was also the case with the sample for comparison No. 4.

The number of the non-metallic inclusions in the sample for comparison No. 6 was as follows:

| | |
|---|---|
| Number of spherical non-metallic inclusions: | |
| Width of under 3 μm | 11, |
| Width of from 3 to under 6 μm | 6, |
| Width of from 6 to under 14 μm | 1, |
| Number of linear non-metallic inclusions: | |
| Width of under 3 μm | 1, |
| Width of 3 μm or over | none. |

More specifically, in the sample for comparison No. 6, there were more spherical non-metallic inclusions than in the samples of the invention Nos. 1 and 2. This was also the case with the sample for comparison No. 5.

All the samples for comparison Nos. 3 to 6 had many non-metallic inclusions, and/or had the non-metallic inclusions having a large particle size, thus impairing etching pierceability of the Fe-Ni alloy cold-rolled sheet. In the samples of the invention Nos. 1 and 2, in contrast, the non-metallic inclusions were fewer and the particle size thereof was smaller, thus resulting in an excellent etching pierceability of the Fe-Ni alloy cold-rolled sheet.

Then, etching-piercing of a diameter of from 135 to 280 μm was actually applied to the above-mentioned samples of the invention Nos. 1 and 2 and the samples for comparison Nos. 3 to 6, and the result was analyzed.

As a result of microscopic observation of the etching-pierced samples, etching-piercing defects could be classified into four Types (A), (B), (C) and (D) as shown in FIG. 8. The result is shown also in Table 3-2.

The sample of the invention No. 1 gave a ratio of reject occurrence in the etching-piercing of null. It was clear that, because of the small number of non-metallic inclusions and the small particle size thereof as described above, the sample of the invention No. 1 was excellent in etching pierceability. In the sample of the invention No. 2 also, although defects of types (C) and (D) occurred, the ratio of occurrence thereof was very low, and it was clear that this sample was excellent in etching pierceability.

In the sample for comparison No. 3, on the other hand, the ratio of reject occurrence in the etching-piercing was as follows:

Ratio of reject occurrence of type (A): 0.04%,
Ratio of reject occurrence of type (B): 0.03%,
Ratio of reject occurrence of type (C): 2.35%, and
Ratio of reject occurrence of type (D): 2.54%.

As is evident from the above description, the sample for comparison No. 3 showed a high ratio of reject occurrence in the etching-piercing. It was thus clear that, because of the large number of linear non-metallic inclusions as described above, the sample for comparison No. 3 was poor in etching pierceability. This was also the case with the sample for comparison No. 4.

In the sample for comparison No. 6, furthermore, the ratio of reject occurrence in the etching-piercing was as follows:

Ratio of reject occurrence of type (A): 0.15%,
Ratio of reject occurrence of type (B): 0.05%,
Ratio of reject occurrence of type (C): 0.82%, and
Ratio of reject occurrence of type (D): 0.01%.

As is clear from the above description, the ratio of reject occurrence in the etching-piercing was high in the sample for comparison No. 6 than in the samples of the invention Nos. 1 and 2. It was clear that, because of the large number of spherical non-metallic inclusions as described above, the sample for comparison No. 6 was poor in etching pierceability. This was also the case with the sample for comparison No. 5.

According to the present invention, as described above in detail, it is possible to provide an Fe-Ni alloy cold-rolled sheet excellent in cleanliness and etching pierceability, which is applicable as a material for a shadow mask of a high-definition TV, free from a defect during the etching-piercing, and has a low thermal expansion coefficient, and a method for manufacturing same, thus providing industrially useful effects.

What is claimed is:

1. A method for manufacturing an Fe-Ni alloy cold-rolled sheet excellent in cleanliness and etching pierceability, which comprises the steps of:

preparing an Fe-Ni molten alloy, containing nickel in an amount within a range of from 30 to 45 wt. %, and subjected to dephosphorization and decarburization;

adding aluminum and flux to said Fe-Ni molten alloy thus prepared, in a ladle made of an MgO-CaO refractory containing CaO in an amount within a range of from 20 to 40 wt. %;

strongly stirring said Fe-Ni molten alloy which contains said added aluminum and flux in said ladle to produce a $CaO-Al_2O_3-MgO$ slag in said ladle, so as to react said Fe-Ni molten alloy with said $CaO-Al_2O_3-MgO$ slag to deoxidize said Fe-Ni molten alloy while controlling a value of activity of $SiO_2$ ($a_{SiO_2}$) within a range of from 0.001 to 0.005 and a value of activity of $Al_2O_3$($A_{Al_2O_3}$) within a range of from 0.1 to 0.3 in said $CaO-Al_2O_3-MgO$ slag, and said $CaO-Al_2O_3-MgO$ slag having the following chemical composition so as to satisfy said values of activities of $SiO_2$ ($a_{SiO_2}$) and $Al_2O_3$($a_{Al_2O_3}$):

| | |
|---|---|
| CaO and $Al_2O_3$ | at least 57 wt. %, |
| MgO | up to 25 wt. %, |
| $SiO_2$ | up to 15 wt. %, |

wherein, the ratio of $CaO/(CaO + Al_2O_3)$ being at least 0.45, and oxides of metals having an oxygen affinity lower than that of silicon: up to 3 wt. % in total;

casting said deoxidized Fe-Ni molten alloy into an ingot; and blooming, hot-rolling and cold-rolling said ingot to manufacture an Fe-Ni alloy cold-rolled sheet containing non-metallic inclusions comprising a composition in a region of a melting point of at least 1,600° C., which region is defined by a liquidus curve of 1,600° C. in a $CaO-Al_2O_3-MgO$ ternary phase diagram and having a particle size up to 6 μm in a total amount of up to 0.002 wt. % as converted into oxygen.

2. The method as claimed in claim 1, wherein:

the total amount of said oxides of metal in said slag is up to 1.5 wt. %.

3. The method as claimed in claim 1, wherein:

said preparation of said Fe-Ni molten alloy comprises the steps:

refining a molten steel in a converter; and dephosphorizing, adding a molten nickel to, and decarburizing said molten steel in said ladle depressurized to up to 600 Torr.

4. The method as claimed in claim 1, wherein:

said deoxidation of said Fe-Ni molten alloy is effected in said ladle depressurized to up to 1 Torr.

5. The method as claimed in any one of claims 1 to 4, wherein:

said blooming of said ingot is effected with a reduction ratio of at least 70% and at a temperature within a range of from 1,150° to 1,250° C.

6. The method as claimed in claim 3, wherein the total amount said oxides of metal in of said slag is up to 1.5 wt. %; said deoxidation of said Fe-Ni molten alloy is carried out in said ladle depressurized to up to 1 Torr; and said blooming of said ingot is carried out with a reduction ratio of at least 70% and at a temperature of 1,150° to 1,250° C.

7. The method as claimed in claim 1, wherein the flux comprises calcined lime and fluorspar.

* * * * *